US005446436A

United States Patent [19]

Williams

[11] Patent Number: 5,446,436

[45] Date of Patent: Aug. 29, 1995

[54] HIGH VOLTAGE HIGH POWER ARC SUPPRESSING FUSE

[75] Inventor: Richard A. Williams, Palo Alto, Calif.

[73] Assignee: Space Systems/Loral, Inc., Palo Alto, Calif.

[21] Appl. No.: 197,667

[22] Filed: Feb. 15, 1994

Related U.S. Application Data

[63] Continuation of Ser. No. 971,309, Nov. 4, 1992, abandoned.

[51] Int. Cl.[6] ..... H01H 85/38

[52] U.S. Cl. ..... 337/273; 337/276

[58] Field of Search ..... 337/273–282

[56] References Cited

U.S. PATENT DOCUMENTS

| | | | |
|---|---|---|---|
| 3,110,787 | 11/1963 | Borzoni | 337/273 |
| 3,179,773 | 4/1965 | Keeley, Sr. | 337/280 |
| 3,601,737 | 8/1971 | Baird | 337/273 |
| 4,169,271 | 9/1979 | Saitoh | 357/51 |
| 4,709,222 | 11/1987 | Morita et al. | 337/273 |
| 4,720,772 | 1/1988 | Yamane | 361/433 |
| 4,763,228 | 8/1988 | Su | 361/433 |
| 4,814,946 | 3/1989 | Su | 361/523 |
| 4,873,506 | 10/1989 | Gurevich | 337/290 |
| 4,935,848 | 6/1990 | Yamane | 361/534 |
| 5,027,101 | 6/1991 | Morrill | 337/297 |

OTHER PUBLICATIONS

"Surface Mount Fuse Specification", Feb. 1991, Cooper Industries, Inc., Bussmann Division, pp. 1–3.

"Overview of Contruction and Operation; Current Limiting Fuses", Mepcopal Company; undated.

*Primary Examiner*—Lincoln Donovan

*Attorney, Agent, or Firm*—Perman & Green

[57] ABSTRACT

A high voltage high power fuse (5) for use in a low pressure environment such as space. The fuse (5) comprises a fuse element (1) which is electrically connected to two conductive pads (2) and surrounded by an elastic medium (3). When the fuse element (1) is vaporized by a current surge, the elastic medium (3) absorbs the energy of the explosion and then snaps back into the space (6) left by the vaporized fuse element (1). This action of the elastic medium (3) effectively quenches any electric arc which may have bridged the gap (6) between the ends of the blown fuse element (1).

11 Claims, 3 Drawing Sheets

HIGH VOLTAGE HIGH POWER ARC SUPPRESSING FUSE

This is a continuation of application Ser. No. 07/971,309 filed on Nov. 4, 1992, is now abandoned.

TECHNICAL FIELD

This invention pertains to the field of high voltage (>100 V) high power (>500 W) fuses for use in a low pressure (<1 Torr) environment such as space.

BACKGROUND ART

Previous high reliability high voltage (>100 V) space qualified fuses have been gas-filled. Because gas-filled fuses may leak in a low pressure (<1 Torr) or vacuum environment such as space, the inside of the fuse may reach critical pressure. A fuse is said to have blown when the fuse element melts or vaporizes, thus interrupting the current through the fuse. If the fuse is blown when the internal pressure is at critical pressure, the fuse will not interrupt the current. The current will instead continue to flow as a flaming arc, destroying the fuse package and surrounding materials. FIG. 1 shows a current and voltage record of this event. At time T=1 second, the voltage increased, but even though the fuse blew at 2 seconds, the current continued to flow in an electric arc. The arc burned until the voltage was removed. This performance was demonstrated repeatedly with 10 A, 125 v fast acting mini-fuses which were evacuated through a 5-10 mil hole in the tubular fuse body.

A liquid or solid immersion of the fuse element may avoid the critical pressure problem if the liquid or solid immersion may be achieved and maintained during the melting and explosive current interruption of the fuse element. Suppliers of fuses have recognized the need for cheap board mounted, small fuses and have developed devices with solid, non gas potting to fill this need. However, presently available fuses are limited to a 6 ampere, 125 volt rating. Above 6 amperes, the voltage rating is reduced to lower the peak burnout energy.

Small amounts of insulating silicone have been utilized in micro components for the purpose of absorbing shock or stress from thermal expansion, providing thermal insulation, and protecting surrounding material. However, large quantities of silicone have not been used to encapsulate the fuse element and suppress arcing.

U.S. Pat. No. 4,935,848 discloses a partially-covered fuse element with an elastic silicone resin for the purpose of preventing a short circuit to an adjoining wall of a capacitor. The thickness of the silicone used does not suggest that the silicone is used to suppress an arc occurring when the fuse blows. The patent also teaches that a plurality of bubbles should be mixed with the silicone, a feature that would inhibit any arc suppressing characteristic the silicone might possess. The present invention encases the fuse element in a thick layer of silicone which is substantially free of air bubbles. The silicone suppresses any arc which may be formed when the fuse blows.

U.S. Pat. No. 4,720,772 similarly describes use of a silicone resin in a micro-fuse and suggests the formation of air bubbles within the resin. It teaches that the bubbles increase the thermal insulating properties of the elastic resin and thus facilitate the melting of the fuse element. The present invention teaches away from forming air bubbles and uses silicone for its elastic properties.

U.S. Pat. No. 4,763,228 describes use of a thin silicone layer with a thickness on the order of the fuse element diameter to prevent charring of the surrounding resinous encapsulant. The silicone layer used in the present invention must be substantially thicker in order to elastically flow into the space left by the blown fuse.

U.S. Pat. No. 4,169,271 describes the use of a small droplet of silicone as a material with a small coefficient of thermal expansion that will not carbonize when heated. When surrounded by a material with a high coefficient of thermal expansion, the silicone is compressed and tends to pinch off the liquefied metal wire before sufficient heat builds up to ignite surrounding material. The present invention covers the entire fuse element with silicone and is intended to operate at higher voltage and current.

U.S. Pat. No. 4,814,946 also describes use of a small strip of silicone to prevent carbonization in a low power device. Arc suppression is not mentioned.

U.S. Pat. No. 5,027,101 describes use of a silicone layer to insulate a sub-miniature (<0.1") fuse, but does not encapsulate the fuse element. The present invention completely encapsulates the fuse element and is used at higher power.

U.S. Pat. No. 4,873,506 discloses arc quenching techniques for fractional and low ampere fuses. It uses a metallo-organic thin film as the fuse element. The present invention uses a metal wire as fuse element and operates at higher power.

A Buss SMD Tron surface mount fuse specification dated February 1991 discloses the use of fuses in high power applications. However, the present invention is operable at higher voltage and current levels. Observation of the material which surrounds the Buss fuse element shows that it does not possess the elastic characteristic of RTV silicone. The elasticity of the silicone in the present invention enables the silicone to snap back into the gap formed by the blown element and quench the arc.

An undated Mepcopal specification discloses the use of a glass coating as an arc suppressant.

DISCLOSURE OF INVENTION

The present invention describes a method of eliminating glow discharge in a high voltage fuse (5) at critical pressure. The fuse element (1) is completely surrounded by an elastic insulating medium (3) which absorbs the energy released when the fuse (5) blows and then elastically snaps back into the space (6) vacated by the blown fuse element (1).

BRIEF DESCRIPTION OF THE DRAWINGS

In FIG. 2*a* the fuse 5 is conducting current. FIG. 2*b* shows the fuse 5 at the instant the fuse element 1 vaporizes. FIG. 2*c* shows the fuse 5 after the elastic medium 3 has filled the gap 6 formed within the blown fuse element 1.

BEST MODE FOR CARRYING OUT THE INVENTION

As used throughout the instant specification and claims, "high voltage" means greater than 100 volts; "high power" means greater than 500 watts; and "low pressure" means less than one Torr. Such low pressure occurs, for example, in outer space, which is an example of an environment in which the present invention finds great utility.

Figure 1:
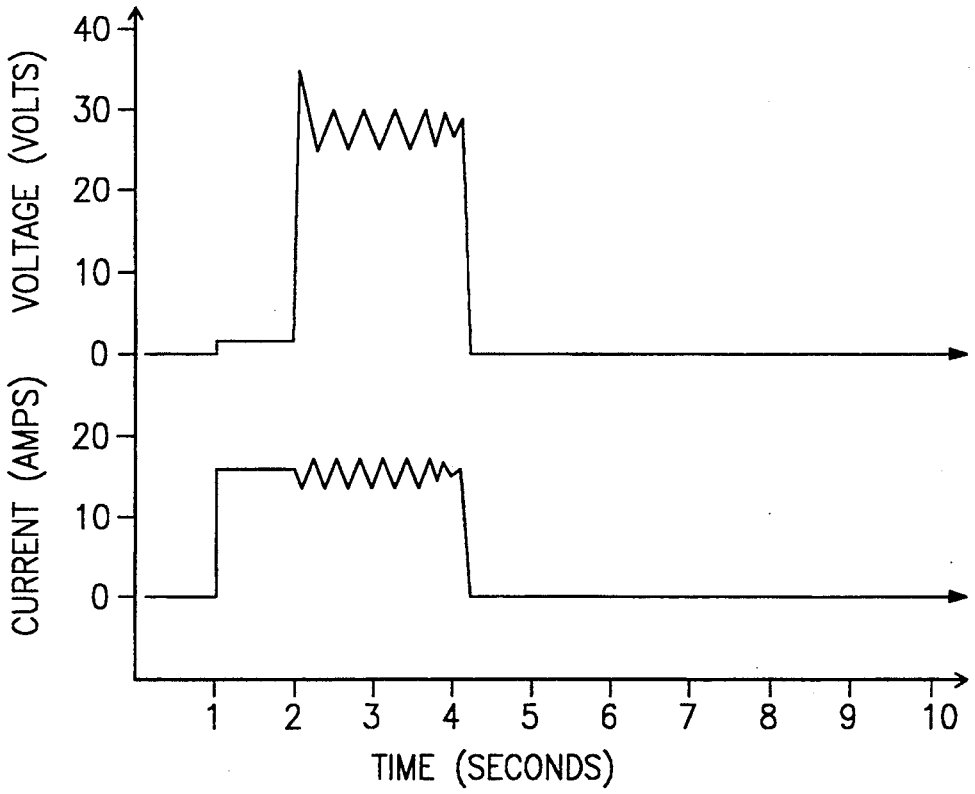
FIG. 1 PRIOR ART
FIG. 1 is a plot of current and voltage when a commercial gas filled fuse of the prior art blows at critical pressure, The current continues to flow in a flaming arc until the voltage is removed.
Figure 2A:
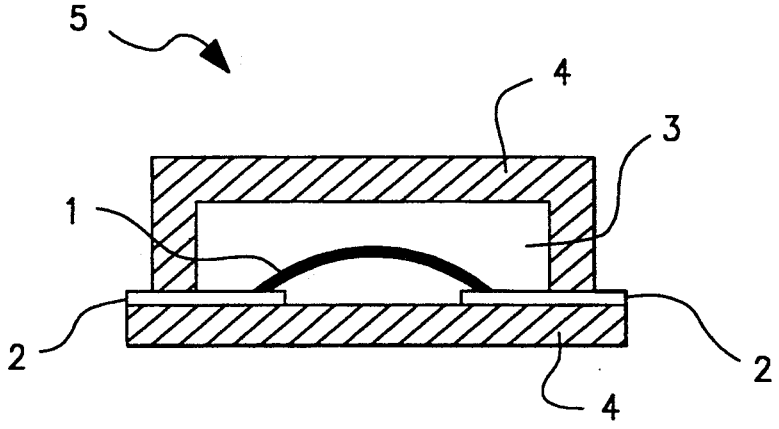
FIGS. 2*a*, 2*b* and 2*c* schematically show the operation of the present invention.
Figure 2B:
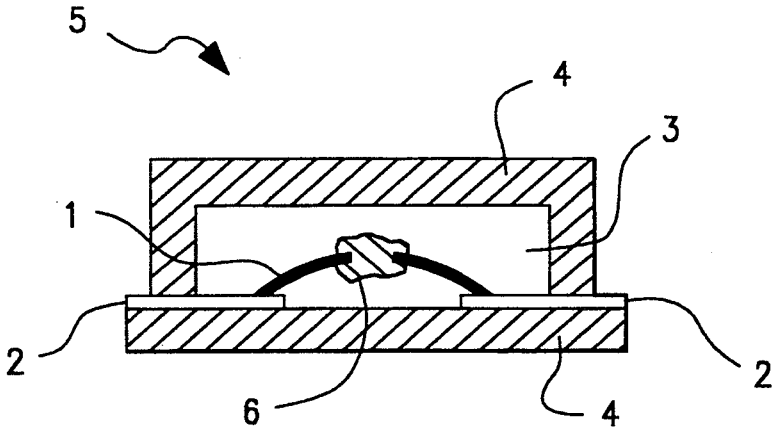

Referring to FIG. 2*a*, fuse element 1 is electrically connected to two conductive pads 2 and is completely surrounded by an elastic medium 3. The fuse elements 1 used in working embodiments were gold and aluminum wire, and the conductive pads 2 were gold. Room Temperature Vulcanized (RTV) silicone rubber was used as the elastic medium 3. The advantage of using silicone is two-fold. First, the silicone 3 seals the fuse element 1 from contact with the low pressure environment of space, thus preventing glow discharge. Second, the silicone 3 absorbs the energy released when the fuse element 1 blows and snaps back into the space 6 vacated by the element 1. This operation is depicted in FIGS. 2*a*–2*c*.

In FIG. 2*a*, the element 1 has not blown. FIG. 2*b* shows the fuse element 1 being vaporized at a region 6, and the surrounding silicone 3 expanding to absorb the energy.

Figure 2C:
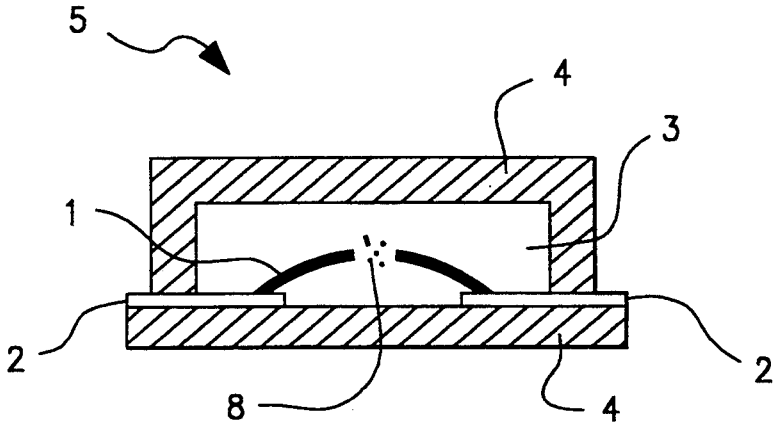

FIG. 2*c* shows that the silicone 3 snaps back into the expanded area between the metal fragments (e.g., balls) 8 which are the remains of the blown fuse element 1.

Figure 3:
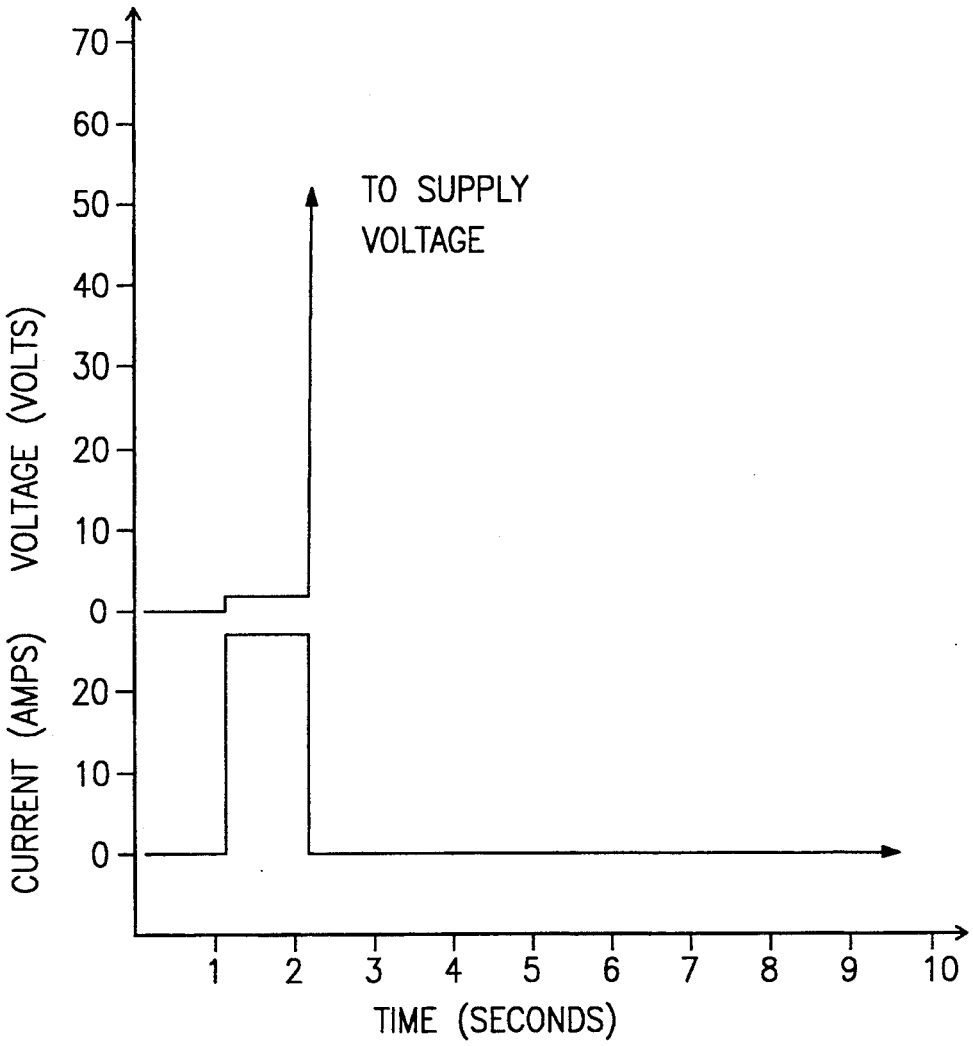
FIG. 3 is a plot of current and voltage when a fuse of the present invention blows at critical pressure. The fuse was tested under a bell jar which was evacuated to a pressure of less than one Torr.

FIG. 3 shows the current, voltage plot of the fuse 5 when it blows. The voltage rises to a high level (i.e., the supply voltage) at 2 seconds, as the fuse blows and the current immediately drops to zero as desired.

In the preferred embodiment of the invention, a ceramic case 4 was used to contain the fuse element 1, interior portions of the conductive pads 2, and the elastic medium 3. The conductive pads 2 extend outside the case 4 to provide an electrical connection to an outside circuit.

The silicone medium 3 used was substantially free of gaseous bubbles and contained no foreign material. It uniformly filled the cavity between the ceramic case 4 and the fuse element 1 with a thickness measured radially outwardly from the fuse element 1 of at least several times the radius of the fuse element 1. The thickness of the silicone 3, the lack of foreign material and gaseous bubbles, and the uniform filling of the cavity are all features which are believed to enhance the elastic arc suppressing action of the silicone 3.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A high voltage fuse for operation in a low pressure environment, said fuse comprising:

a fuse element electrically connected to at least two conductive elements, said fuse element having a length and a transverse dimension; wherein said fuse element is encapsulated within an encapsulating package containing an elastic insulating material, said elastic insulating material having a thickness greater than the transverse dimension of said fuse element;

said elastic insulating material completely fills said encapsulating package and is substantially free of voids and gaseous bubbles, with substantially no gas being present within said encapsulating package; and said elastic insulating material completely covers said fuse element along the entire length thereof and isolates it from said environment, said elastic insulating material being selected to have an elastic property enabling said elastic insulating material to rapidly fill a void that is created along the length of said fuse element due to a portion of said fuse element being vaporized by an electrical current.

2. The apparatus of claim 1 wherein said insulating material is silicone.

3. The apparatus of claim 1 wherein said encapsulating package is uniformly filled with said elastic insulating material.

4. The apparatus of claim 2 wherein said silicone is RTV silicone and is substantially free of gaseous bubbles and contaminating foreign material.

5. A method of preventing glow discharge in a high voltage fuse at critical pressure, said method comprising the steps of:

providing a fuse element having a length and a radius;

completely encapsulating said fuse element along the entire length thereof in an elastic insulating material, said elastic insulating material being substantially free of voids and gaseous bubbles, the elastic insulating material encapsulating said fuse element with a thickness greater than two times the radius of said fuse element; and completely encapsulating said insulating material in an outer housing, with substantially no gas being present within said outer housing, wherein the elastic insulating material is selected to have an elastic property enabling the elastic insulating material to rapidly fill a void that is created along the length of the fuse element due to a portion of the fuse element being vaporized by an electrical current.

6. The method of claim 5 wherein said material has a thickness measured radially outwardly from said fuse element, wherein said thickness is at least several times the radius of said fuse element.

7. The method of claim 5 wherein said insulating material is silicone.

8. The method of claim 7 wherein said silicone is substantially free of gaseous bubbles and contaminating foreign material.

9. A method of quenching an electric arc resulting from a blown fuse element, said method comprising the steps of:

providing a fuse element having a length and a radius;

completely surrounding the fuse element along the entire length thereof with an elastic medium, the elastic medium being substantially free of voids and gaseous bubbles and surrounding the fuse element with a thickness greater than two times the radius of the fuse element;

completely enclosing said elastic medium in a rigid container, with substantially no gas being present within said rigid container; and applying sufficient electrical power across the fuse element to cause the fuse element to blow, said elastic medium absorbing the energy released by said fuse element; wherein said elastic medium then elastically flows into a space left by the vaporized fuse element, thereby blocking the flow of current through said space.

10. The method of claim 9 wherein said elastic medium is silicone.

11. The method of claim 10 wherein said silicone is substantially free of gaseous bubbles and contaminating foreign material.

* * * * *